US009790666B2

(12) United States Patent
Kawamoto et al.

(10) Patent No.: US 9,790,666 B2
(45) Date of Patent: Oct. 17, 2017

(54) CALIBRATION SYSTEM, WORK MACHINE, AND CALIBRATION METHOD

(71) Applicant: Komatsu Ltd., Tokyo (JP)

(72) Inventors: Shun Kawamoto, Hiratsuka (JP); Taiki Sugawara, Hiratsuka (JP); Hiroyoshi Yamaguchi, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/915,743

(22) PCT Filed: Sep. 30, 2015

(86) PCT No.: PCT/JP2015/077872
§ 371 (c)(1),
(2) Date: Mar. 1, 2016

(87) PCT Pub. No.: WO2016/047807
PCT Pub. Date: Mar. 31, 2016

(65) Prior Publication Data
US 2017/0089041 A1 Mar. 30, 2017

(51) Int. Cl.
*G01M 17/00* (2006.01)
*E02F 9/26* (2006.01)
(Continued)

(52) U.S. Cl.
CPC ..... *E02F 9/261* (2013.01); *E02F 9/2203* (2013.01); *E02F 9/262* (2013.01); *E02F 9/265* (2013.01); *E02F 3/32* (2013.01)

(58) Field of Classification Search
CPC ..... E02F 9/264; G01S 19/42; G01S 19/47; G01S 19/54; G01F 19/00
(Continued)

(56) References Cited

U.S. PATENT DOCUMENTS

2013/0166143 A1* 6/2013 Seki ..... E02F 9/264 701/34.4

FOREIGN PATENT DOCUMENTS

JP 2001-055762 A 2/2001
JP 2010-014535 A 1/2010
(Continued)

OTHER PUBLICATIONS

International Search Report and Written Opinion mailed Dec. 28, 2015, issued for PCT/JP2015/077872.

*Primary Examiner* — Gertrude Arthur Jeanglaude
(74) *Attorney, Agent, or Firm* — Locke Lord LLP

(57) ABSTRACT

A calibration method includes: detecting a predetermined position of a work machine according to first and second methods in a different posture of the work machine; and obtaining a conversion information item used to convert a position detected by the first method from a coordinate system in the first method into a coordinate system different from that of the first method or obtaining a conversion information item used to convert a position detected by the second method from a coordinate system of the second method into a coordinate system different from that of the second method by using a first position information item as information for the predetermined position detected by the first method and a second position information item as information for the predetermined position detected by the second method in a posture of the work machine when the predetermined position is detected by the first method.

9 Claims, 10 Drawing Sheets

(51) Int. Cl.
*E02F 9/22* (2006.01)
*E02F 3/32* (2006.01)

(58) Field of Classification Search
USPC ..... 701/34.3, 34.4, 50; 172/4.5, 9
See application file for complete search history.

(56) References Cited

FOREIGN PATENT DOCUMENTS

| | | | |
|---|---|---|---|
| JP | 2010-060344 | A | 3/2010 |
| JP | 2010-066117 | A | 3/2010 |
| JP | 2012-233353 | A | 11/2012 |
| JP | 2014-181092 | A | 9/2014 |

* cited by examiner

L=L1

L=L2

L=L3

CALIBRATION SYSTEM, WORK MACHINE, AND CALIBRATION METHOD

FIELD

The present invention relates to a calibration system, a work machine, and a calibration method for calibrating a position detecting unit provided in a work machine and detecting the position of an object.

BACKGROUND

As a method of detecting the position of an object, there is known a work machine including an image capturing device (for example, Patent Literature 1).

CITATION LIST

Patent Literature

Patent Literature 1: Japanese Laid-open Patent Publication No. 2012-233353

SUMMARY

Technical Problem

For example, when the position of the object is in a coordinate system of a position detector provided in the work machine so as to detect the position of the object, the coordinate system of the position detector needs to be converted into a different coordinate system in order to determine whether the position of the detected object exists on any position on a globe based on the detected position. Patent Literature 1 discloses a technique of calibrating the work machine by an image capturing device. However, in Patent Literature 1, the conversion of the position of the object detected by the position detector provided in the work machine into a coordinate system other than the position detector is not described.

An object of the invention is to obtain a conversion information item for converting a position information item of the object detected by the position detector provided in the work machine into the coordinate system other than the position detector.

Solution to Problem

According to the present invention, a calibration system comprises: a first position detecting unit which is provided in a work machine including a working implement so as to detect a position of an object; and a processing unit which obtains and outputs a conversion information item used to convert the position detected by the first position detecting unit from a coordinate system of the first position detecting unit into a coordinate system different from the coordinate system of the first position detecting unit or a conversion information item used to convert the position detected by a second position detecting unit from a coordinate system of the second position detecting unit into a coordinate system different from the coordinate system of the second position detecting unit by using a first position information item as an information item for a predetermined position of the work machine detected by the first position detecting unit and a second position information item as an information item for the predetermined position detected by the second position detecting unit in a posture of the work machine when the first position detecting unit detects the predetermined position.

In the present invention, it is preferable that the first position information item corresponds to a plurality of information items obtained when the first position detecting unit detects the predetermined position in a different posture of the work machine, and wherein the second position information item corresponds to a plurality of information items obtained when the second position detecting unit detects the predetermined position in a different posture of the work machine.

In the present invention, it is preferable that the first position detecting unit is a stereo camera including at least a pair of image capturing devices, and wherein the second position detecting unit is a sensor provided in the work machine so as to detect an operation amount of an actuator operating the working implement.

In the present invention, it is preferable that the predetermined position corresponds to a plurality of positions of the work machine in an arrangement direction of the pair of image capturing devices constituting the stereo camera.

According to the present invention, a work machine comprises: a working implement; and the calibration system.

According to the present invention, a calibration method comprises: detecting a predetermined position of a work machine according to a first method and a second method in a different posture of the work machine; and obtaining a conversion information item used to convert a position detected by the first method from a coordinate system in the first method into a coordinate system different from the coordinate system of the first method or obtaining a conversion information item used to convert a position detected by the second method from a coordinate system of the second method into a coordinate system different from the coordinate system of the second method by using a first position information item as an information item for the predetermined position detected by the first method and a second position information item as an information item for the predetermined position detected by the second method in a posture of the work machine when the predetermined position is detected by the first method.

In the present invention, it is preferable that the first position information item and the second position information item are a plurality of information items obtained in various states and respectively obtained when the work machine takes a different posture during an operation of the work machine.

In the present invention, it is preferable that wherein the first method is to stereoscopically and three-dimensionally measure the predetermined position, and wherein the predetermined position corresponds to a plurality of positions of the work machine in an arrangement direction of the pair of image capturing devices used for the stereoscopic and three-dimensional measurement.

According to the invention, it is possible to obtain a conversion information item for converting a position information item of the object detected by the position detector provided in the work machine into the coordinate system other than the position detector.

DESCRIPTION OF EMBODIMENTS

A mode for carrying out the invention (an embodiment) will be described in detail with reference to the drawings.

Entire Configuration of Excavator

Figure 1:
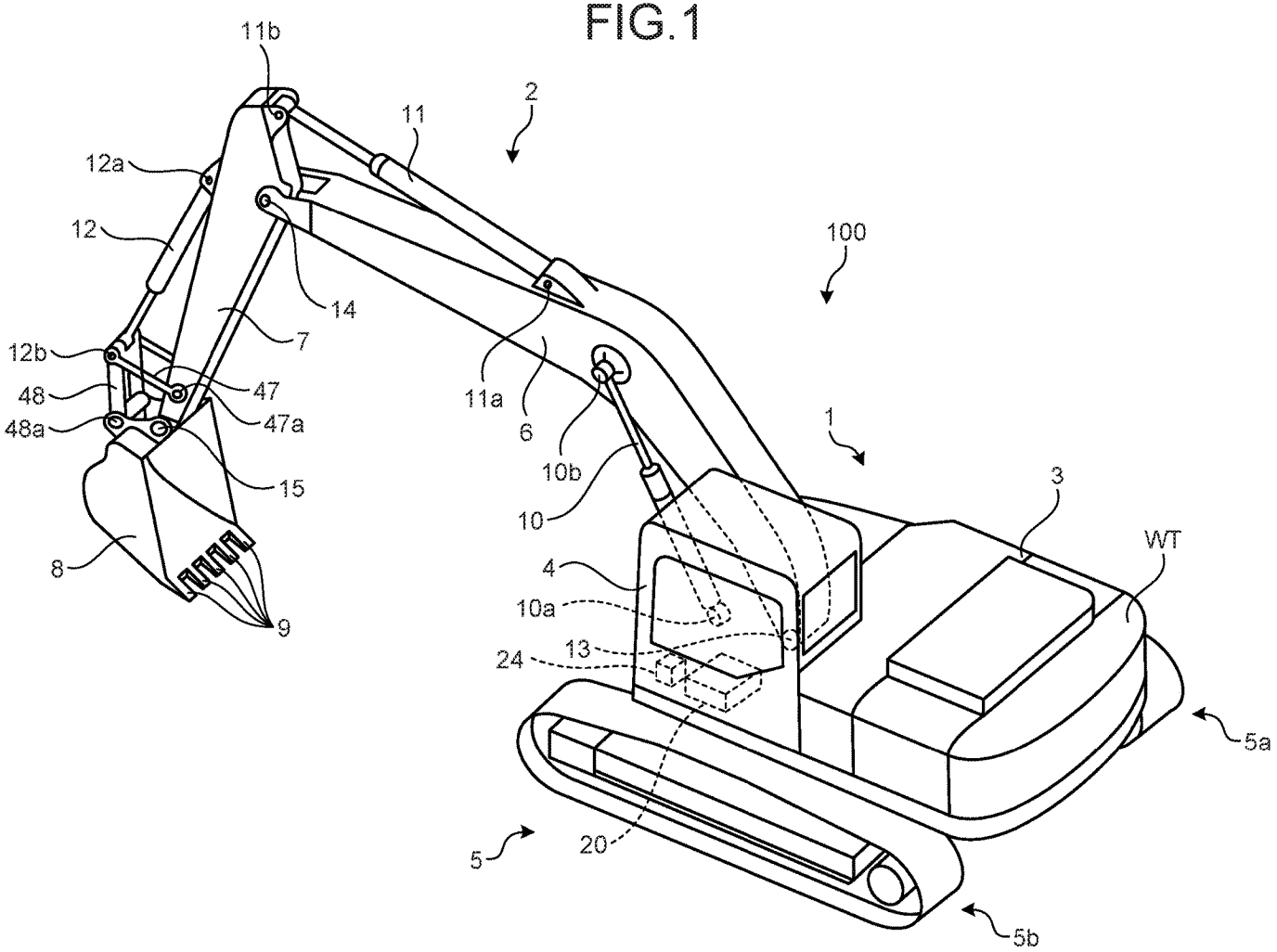
FIG. 1 is a perspective view illustrating an excavator including a calibration system according to an embodiment.
Figure 2:
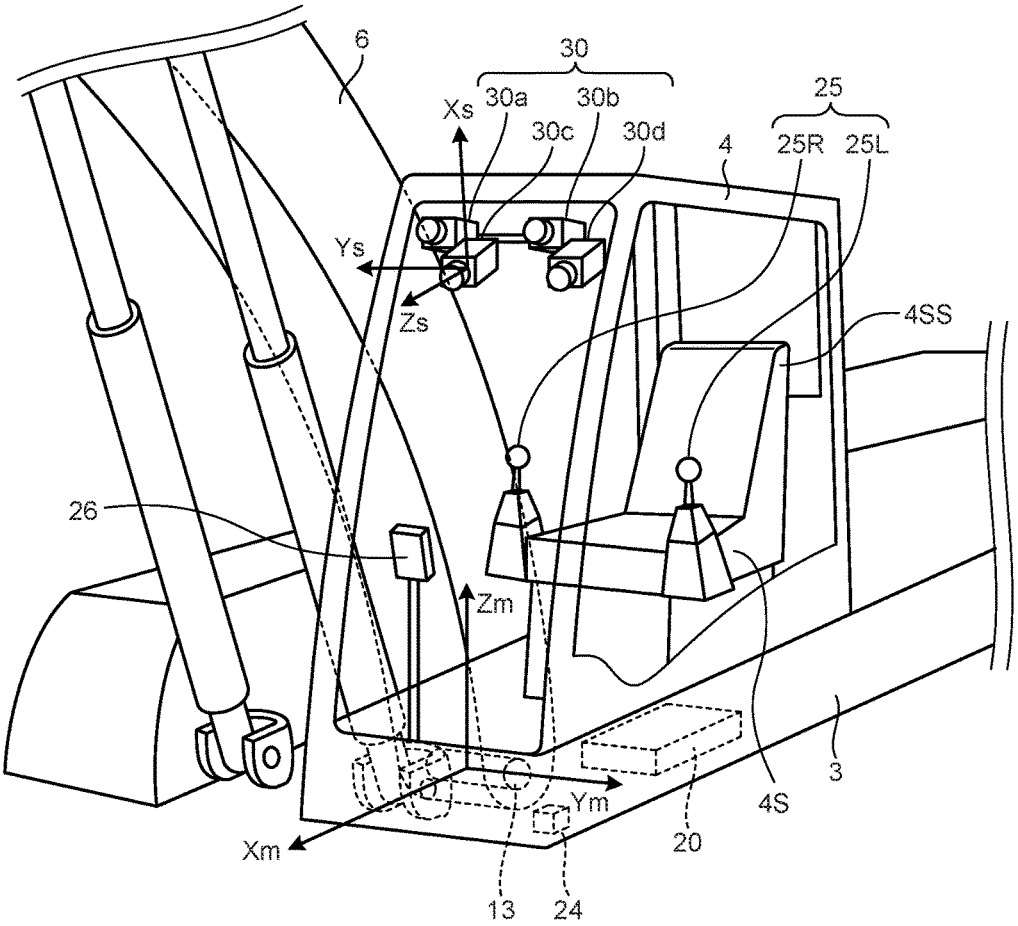
FIG. 2 is a perspective view illustrating the vicinity of a driver seat of the excavator according to the embodiment.
Figure 3:
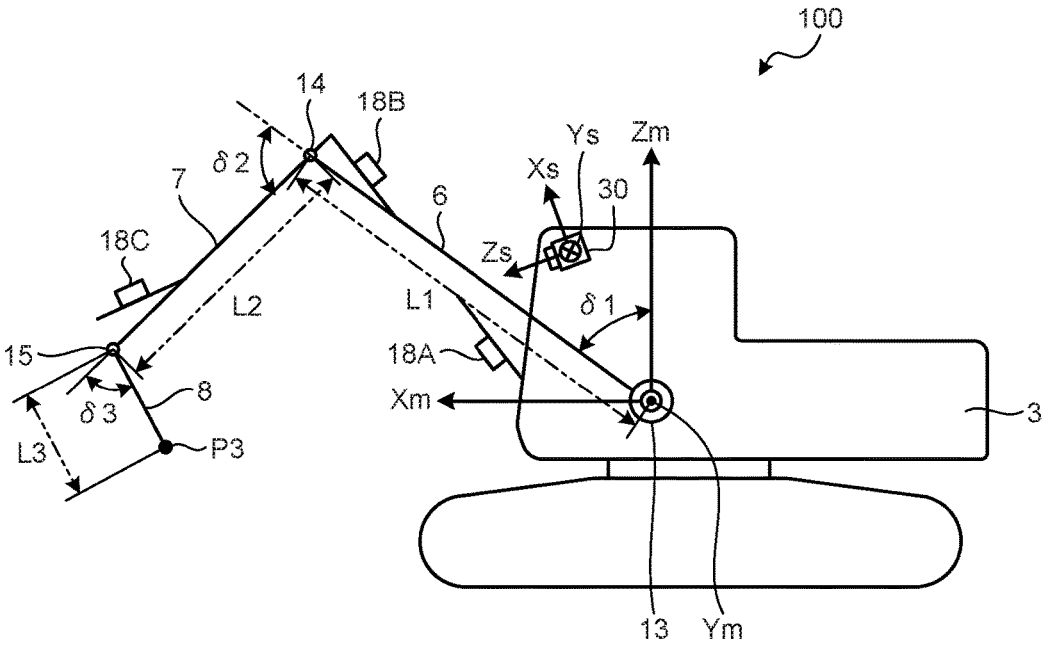
FIG. 3 is a diagram illustrating the coordinate system of the excavator and the dimension of a working implement including the excavator according to the embodiment.

FIG. 1 is a perspective view illustrating an excavator 100 including a calibration system according to the embodiment. FIG. 2 is a perspective view illustrating the vicinity of a driver seat of the excavator 100 according to the embodiment. FIG. 3 is a diagram illustrating the coordinate system of the excavator 100 and the dimension of a working implement 2 of the excavator according to the embodiment.

The excavator 100 as the work machine includes a vehicle body 1 and the working implement 2. The vehicle body 1 includes a swing body 3, a cab 4, and a traveling body 5. The swing body 3 is attached to the traveling body 5 in a swingable manner. The swing body 3 accommodates a device such as a hydraulic pump and an engine (not illustrated). The cab 4 is disposed at the front portion of the swing body 3. An operation device 25 illustrated in FIG. 2 is disposed inside the cab 4. The traveling body 5 includes crawlers 5*a* and 5*b*, and the excavator 100 travels by the rotation of the crawlers 5*a* and 5*b*.

The working implement 2 is attached to the front portion of the vehicle body 1, and includes a boom 6, an arm 7, a bucket 8 as a working tool, a boom cylinder 10, an arm cylinder 11, and a bucket cylinder 12. In the embodiment, the front direction of the vehicle body 1 indicates a direction from a backrest 4SS of a driver seat 4S illustrated in FIG. 2 toward the operation device 25. The rear direction of the vehicle body 1 indicates a direction from the operation device 25 toward the backrest 4SS of the driver seat 4S. The front portion of the vehicle body 1 indicates the front portion of the vehicle body 1 and the opposite portion from a counter weight WT of the vehicle body 1. The operation device 25 is a device for operating the working implement 2 and the swing body 3, and includes a right lever 25R and a left lever 25L. Inside the cab 4, a monitor panel 26 is provided in front of the driver seat 4S.

The base end of the boom 6 is rotatably attached to the front portion of the vehicle body 1 through a boom pin 13. The boom pin 13 corresponds to the rotation center of the boom 6 with respect to the swing body 3. The base end of the arm 7 is rotatably attached to the front end of the boom 6 through an arm pin 14. The arm pin 14 corresponds to the rotation center of the arm 7 with respect to the boom 6. The bucket 8 is rotatably attached to the front end of the arm 7 through a bucket pin 15. The bucket pin 15 corresponds to the rotation center of the bucket 8 with respect to the arm 7.

As illustrated in FIG. 3, the length of the boom 6, that is, the length between the boom pin 13 and the arm pin 14 is L1. The length of the arm 7, that is, the length between the arm pin 14 and the bucket pin 15 is L2. The length of the bucket 8, that is, the length between the bucket pin 15 and a blade tip P3 as a tip of a blade 9 of the bucket 8 is L3.

The boom cylinder 10, the arm cylinder 11, and the bucket cylinder 12 illustrated in FIG. 1 are hydraulic cylinders driven by a hydraulic pressure. These hydraulic cylinders are provided in the vehicle body 1 of the excavator 100, and are actuators for operating the working implement 2. The base end of the boom cylinder 10 is rotatably attached to the swing body 3 through a boom cylinder foot pin 10*a*. The front end of the boom cylinder 10 is rotatably attached to the boom 6 through a boom cylinder top pin 10*b*. The boom cylinder 10 is lengthened and shortened by a hydraulic pressure so as to drive the boom 6.

The base end of the arm cylinder 11 is rotatably attached to the boom 6 through an arm cylinder foot pin 11*a*. The front end of the arm cylinder 11 is rotatably attached to the arm 7 through an arm cylinder top pin 11*b*. The arm cylinder 11 is lengthened and shortened by a hydraulic pressure so as to drive the arm 7.

The base end of the bucket cylinder 12 is rotatably attached to the arm 7 through a bucket cylinder foot pin 12*a*. The front end of the bucket cylinder 12 is rotatably attached to one end of a first link member 47 and one end of a second link member 48 through a bucket cylinder top pin 12*b*. The other end of the first link member 47 is rotatably attached to the front end of the arm 7 through a first link pin 47*a*. The other end of the second link member 48 is rotatably attached to the bucket 8 through a second link pin 48*a*. The bucket cylinder 12 is lengthened and shortened by a hydraulic pressure so as to drive the bucket 8.

As illustrated in FIG. 3, the boom 6, the arm 7, and the bucket 8 are respectively provided with a first angle detecting unit 18A, a second angle detecting unit 18B, and a third angle detecting unit 18C. The first angle detecting unit 18A, the second angle detecting unit 18B, and the third angle detecting unit 18C are, for example, stroke sensors. When these angle detecting units respectively detect the stroke length values of the boom cylinder 10, the arm cylinder 11, and the bucket cylinder 12, the rotation angle of the boom 6 with respect to the vehicle body 1, the rotation angle of the arm 7 with respect to the boom 6, and the rotation angle of the bucket 8 with respect to the arm 7 are indirectly detected.

In the embodiment, the first angle detecting unit 18A detects the operation amount, that is, the stroke length of the boom cylinder 10. A processing device 20 to be described later calculates the rotation angle δ1 of the boom 6 in the axis Zm of the coordinate system (Xm, Ym, and Zm) of the excavator 100 illustrated in FIG. 3 from the stroke length of the boom cylinder 10 detected by the first angle detecting unit 18A. In the description below, the coordinate system of the excavator 100 will be appropriately referred to as the vehicle body coordinate system. As illustrated in FIG. 2, the origin of the vehicle body coordinate system is the center of the boom pin 13. The center of the boom pin 13 indicates the center of the cross-section obtained when the boom pin 13 is cut along the plane perpendicular to the extension direction of the boom pin 13, that is, the center of the boom pin 13 in the extension direction. The vehicle body coordinate system is not limited to the example of the embodiment. For example, the swing center of the swing body 3 may be set as the axis Zm, the axis parallel to the extension direction of the boom pin 13 may be set as the axis Ym, and the axis orthogonal to the axis Zm and the axis Ym may be set as the axis Xm.

The second angle detecting unit 18B detects the operation amount, that is, the stroke length of the arm cylinder 11. The processing device 20 calculates the rotation angle δ2 of the arm 7 with respect to the boom 6 from the stroke length of the arm cylinder 11 detected by the second angle detecting unit 18B. The third angle detecting unit 18C detects the operation amount, that is, the stroke length of the bucket cylinder 12. The processing device 20 calculates the rotation angle δ3 of the bucket 8 with respect to the arm 7 from the stroke length of the bucket cylinder 12 detected by the third angle detecting unit 18C.

Image Capturing Device

As illustrated in FIG. 2, the excavator 100 includes, for example, a plurality of image capturing devices 30*a*, 30*b*, 30*c*, and 30*d* inside the cab 4. In the description below, the plurality of image capturing devices 30*a*, 30*b*, 30*c*, and 30*d* will be appropriately referred to as the image capturing device 30 unless otherwise specified. The type of the image capturing device 30 is not limited. However, in the embodiment, for example, an image capturing device including a CCD (Couple Charged Device) image sensor or a CMOS (Complementary Metal Oxide Semiconductor) image sensor is used.

In the embodiment, the plurality of (four) image capturing devices 30*a*, 30*b*, 30*c*, and 30*d* is attached to the excavator 100. More specifically, as illustrated in FIG. 2, the image capturing device 30*a* and the image capturing device 30*b* are disposed inside, for example, the cab 4 so as to face the same direction while being separated from each other at a predetermined gap therebetween. The image capturing device 30*c* and the image capturing device 30*d* are disposed inside the cab 4 so as to face the same direction while being separated from each other at a predetermined gap therebetween. The image capturing device 30*b* and the image capturing device 30*d* may be disposed so as to slightly face the working implement 2 or the image capturing device 30*a* and the image capturing device 30*c*. In the plurality of image capturing devices 30*a*, 30*b*, 30*c*, and 30*d*, the stereo camera is obtained by the combination of two image capturing devices. In the embodiment, the stereo camera is obtained by the combination of the image capturing devices 30*a* and 30*b* and the combination of the image capturing devices 30*c* and 30*d*.

In the embodiment, the excavator 100 includes four image capturing devices 30. However, the number of the image capturing devices 30 of the excavator 100 may be least two and is not limited to four. The excavator 100 provides a stereo camera including at least the pair of image capturing devices 30 in order to stereoscopically capture an object.

The plurality of image capturing devices 30*a*, 30*b*, 30*c*, and 30*d* is disposed at the front upper portion inside the cab 4. The up direction indicates a direction orthogonal to the treads of the crawlers 5*a* and 5*b* of the excavator 100 and separated from the treads. The treads of the crawlers 5*a* and 5*b* indicate planes defined by at least three points not existing on the same line in a grounding portion of at least one of the crawlers 5*a* and 5*b*. The plurality of image capturing devices 30*a*, 30*b*, 30*c*, and 30*d* stereoscopically captures an object existing in front of the vehicle body 1 of the excavator 100. The object is, for example, an object to be excavated by the working implement 2. The processing device 20 illustrated in FIGS. 1 and 2 three-dimensionally measures the object by using the stereoscopically capturing result obtained by at least the pair of image capturing devices 30. That is, the processing device 20 three-dimensionally measures the above-described object by performing a stereoscopic imaging process on the image of the same object captured by at least the pair of image capturing devices 30. The arrangement positions of the plurality of image capturing devices 30*a*, 30*b*, 30*c*, and 30*d* are not limited to the front upper portion inside the cab 4.

Figure 4:
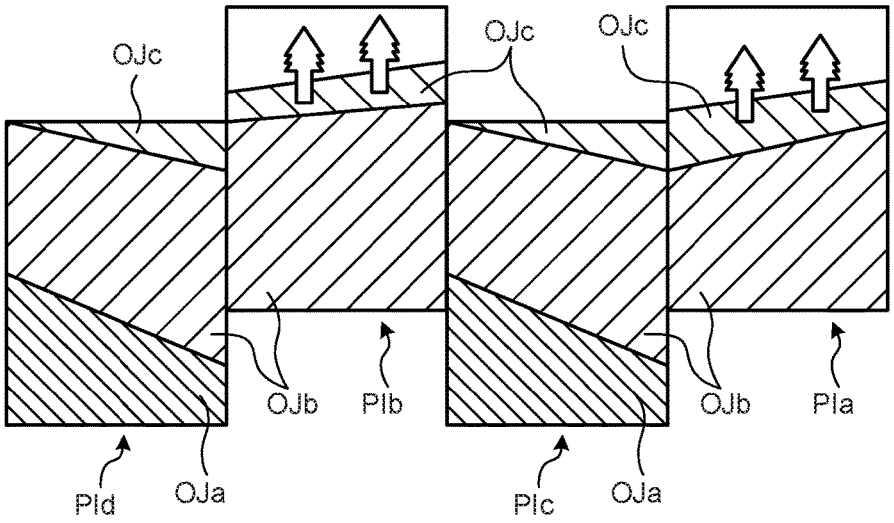
FIG. 4 is a diagram illustrating an example of an image obtained by capturing an object by a plurality of image capturing devices.
Figure 5:
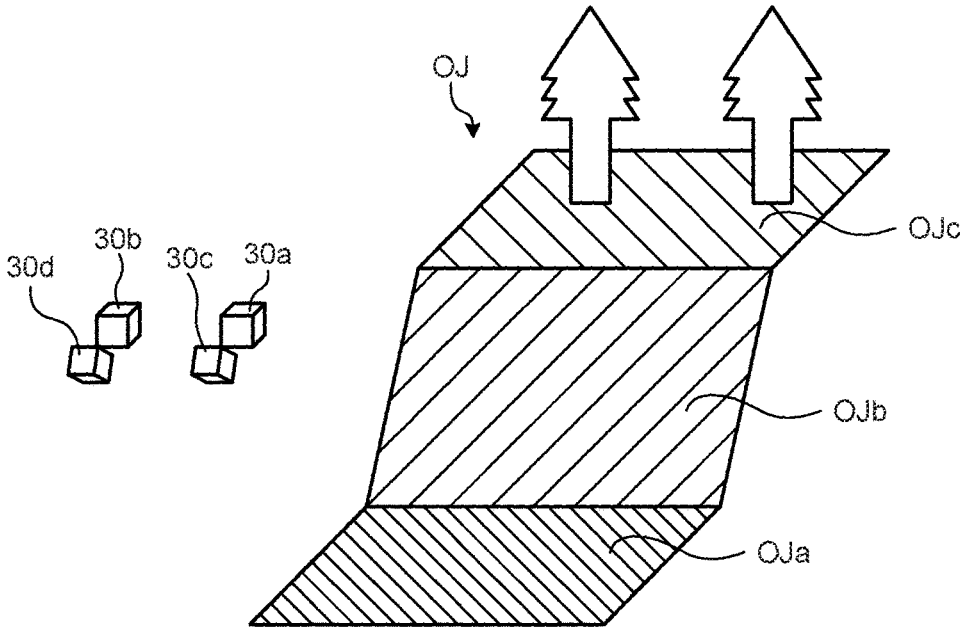
FIG. 5 is a diagram illustrating an example of an image obtained by capturing an object by the plurality of image capturing devices.

FIG. 4 is a diagram illustrating an example of the image obtained by capturing the object using the plurality of image capturing devices 30*a*, 30*b*, 30*c*, and 30*d*. FIG. 5 is a diagram illustrating an example of an object OJ captured by the plurality of image capturing devices 30*a*, 30*b*, 30*c*, and 30*d*. For example, images PIa, PIb, PIc, and PId illustrated in FIG. 4 can be obtained by capturing the object OJ using the plurality of image capturing devices 30*a*, 30*b*, 30*c*, and 30*d* illustrated in FIG. 5. In this example, the object OJ includes a first portion OJa, a second portion OJb, and a third portion OJc.

The image PIa is captured by the image capturing device 30*a*, the image PIb is captured by the image capturing device 30*b*, the image PIc is captured by the image capturing device 30*c*, and the image PId is captured by the image capturing device 30*d*. Since the pair of image capturing devices 30*a* and 30*b* is disposed so as to be directed toward the upper portion of the excavator 100, the upper portion of the object OJ is included in the images PIa and PIb. Since the pair of image capturing devices 30*c* and 30*d* is disposed so as to be directed toward the lower portion of the excavator 100, the lower portion of the object OJ is included in the images PIc and PId.

As understood from FIG. 4, a part of the area of the object OJ, that is, the second portion OJb in this example is included in the images PIa and PIb captured by the pair of image capturing devices 30*a* and 30*b* and the images PIc and PId captured by the pair of image capturing devices 30*c* and 30*d*. That is, the image capturing areas of the pair of image capturing devices 30*a* and 30*b* directed upward and the image capturing areas of the pair of image capturing devices 30*c* and 30*d* directed downward have an overlapping portion.

When the processing device 20 performs a stereoscopic imaging process on the images PIa, PIb, PIc, and PId of the same object OJ captured by the plurality of image capturing devices 30*a*, 30*b*, 30*c*, and 30*d*, a first parallax image is obtained from the images PIa and PIb captured by the pair of image capturing devices 30*a* and 30*b*. Further, the processing device 20 obtains a second parallax image from the images PIc and PId captured by the pair of image capturing devices 30*c* and 30*d*. Subsequently, the processing device 20 obtains one parallax image so that the first parallax image matches the second parallax image. The processing device 20 three-dimensionally measures the object by using the obtained parallax images. In this way, the processing device 20 and the plurality of image capturing devices 30*a*, 30*b*, 30*c*, and 30*d* three-dimensionally measure a predetermined entire area of the object OJ by one image capturing operation.

In the embodiment, the image capturing device 30*c* among four image capturing devices 30*a*, 30*b*, 30*c*, and 30*d* is set as the reference of four image capturing devices 30*a*, 30*b*, 30*c*, and 30*d*. The coordinate system (Xs, Ys, and Zs) of the image capturing device 30*c* will be appropriately referred to as the image capturing device coordinate system. The origin of the image capturing device coordinate system is the center of the image capturing device 30*c*. The origin of each of the coordinate systems of the image capturing device 30*a*, the image capturing device 30*b*, and the image capturing device 30*d* is the center of the image capturing device.

Calibration System

Figure 6:
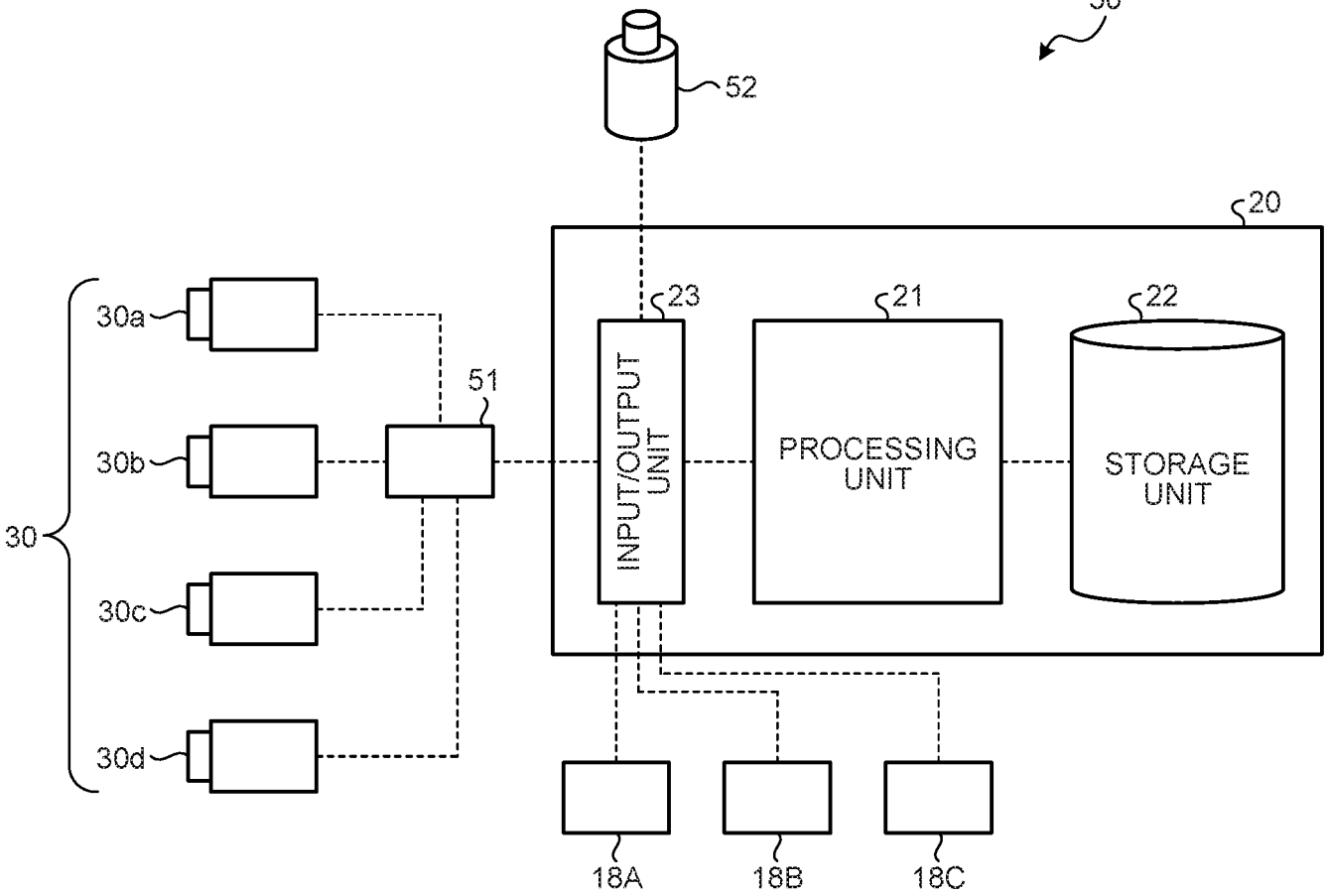
FIG. 6 is a diagram illustrating a calibration system according to the embodiment.

FIG. 6 is a diagram illustrating a calibration system 50 according to the embodiment. The calibration system 50 includes the plurality of image capturing devices 30*a*, 30*b*, 30*c*, and 30*d* and the processing device 20. As illustrated in FIGS. 1 and 2, these components are provided in the vehicle body 1 of the excavator 100. The plurality of image capturing devices 30*a*, 30*b*, 30*c*, and 30*d* is attached to the excavator 100 as the work machine so as to capture the object and output the image of the object to the processing device 20.

The processing device 20 includes a processing unit 21, a storage unit 22, and an input/output unit 23. The processing unit 21 is realized by, for example, a processor such as a CPU (Central Processing Unit) and a memory. The processing device 20 realizes the calibration method according to the embodiment. In this case, the processing unit 21 reads out a computer program stored in the storage unit 22. The computer program is used to perform the calibration method according to the embodiment by the processing unit 21.

The processing device 20 obtains the position of the object by performing the stereoscopic imaging process on the pair of images captured by at least the pair of image capturing devices 30 when the calibration method according to the embodiment is performed. Specifically, the processing device obtains the coordinate of the object in the three-dimensional coordinate system. In this way, the processing device 20 can three-dimensionally measure the object by using the pair of images obtained by capturing the same object using at least the pair of image capturing devices 30. That is, at least the pair of image capturing devices 30 and the processing device 20 are used to three-dimensionally measure the object in a stereoscopic manner. In the embodiment, at least the pair of image capturing devices 30 and the processing device 20 correspond to the first position detecting unit provided in the excavator 100 so as to detect and output the position of the object. When the image capturing device 30 has a function of three-dimensionally measuring the object by performing the stereoscopic imaging process, at least the pair of image capturing devices 30 corresponds to the first position detecting unit. In the embodiment, the first position detecting unit detects the position of the object according to a first method and outputs the detection result. The first method is used to three-dimensionally measure an object, for example, a predetermined position of the excavator 100 as the work machine of the embodiment in a stereoscopic manner, but the invention is not limited to the stereoscopic three-dimensional measurement. For example, the predetermined position of the excavator 100 may be measured by a laser length measuring unit. In the embodiment, the predetermined position of the excavator 100 used in the first method is a predetermined position of the working implement 2, but is not limited to the predetermined position of the working implement 2 as long as a predetermined position of the component constituting the excavator 100 is set.

The storage unit 22 uses at least one of a non-volatile or volatile semiconductor memory such as a RAM (Random Access Memory), a ROM (Random Access Memory), a flash memory, an EPROM (Erasable Programmable Random Access Memory), an EEPROM (Electrically Erasable Programmable Random Access Memory), a magnetic disk, a flexible disk, and an optical magnetic disk. The storage unit 22 stores a computer program for performing the calibration method according to the embodiment by the processing unit 21. The storage unit 22 stores information item used to perform the calibration method according to the embodiment by the processing unit 21. This an information item includes, for example, calibration data in each image capturing device 30, the posture of each image capturing device 30, a positional relation between the image capturing devices 30, the given dimension of the working implement 2 or the like, a given dimension indicating a positional relation between the image capturing device 30 and the fixed object provided in the excavator 100, a given dimension indicating the positional relation from the origin of the vehicle body coordinate system to each image capturing device 30 or a certain image capturing device 30, and information item necessary to obtain the position of a part of the working implement 2 from the posture of the working implement 2.

The input/output unit 23 is an interface circuit for connecting the processing device 20 to equipment. A hub 51, an input device 52, the first angle detecting unit 18A, the second angle detecting unit 18B, and the third angle detecting unit 18C are connected to the input/output unit 23. The plurality of image capturing devices 30*a*, 30*b*, 30*c*, and 30*d* is connected to the hub 51. The image capturing device 30 may be connected to the processing device 20 without using the hub 51. The result captured by the image capturing devices 30*a*, 30*b*, 30*c*, and 30*d* is input to the input/output unit 23 through the hub 51. The processing unit 21 acquires the capturing result obtained by the image capturing devices 30*a*, 30*b*, 30*c*, and 30*d* through the hub 51 and the input/output unit 23. The input device 52 is used to input information item necessary to perform the calibration method according to the embodiment by the processing unit 21.

The input device 52 is, for example, a switch and a touch panel, but the invention is not limited thereto. In the embodiment, the input device 52 is provided in the vicinity of the driver seat 4S inside the cab 4 illustrated in FIG. 2. The input device 52 may be attached to at least one of the right lever 25R and the left lever 25L of the operation device 25 or may be provided in the monitor panel 26 inside the cab 4. Further, the input device 52 may be separable from the input/output unit 23 and may input information item to the input/output unit 23 by a radio communication using radio waves or infrared rays.

A predetermined position of the working implement 2 in the vehicle body coordinate system (Xm, Ym, and Zm) is obtained from the dimensions of the components of the working implement 2 and the rotation angles δ1, δ2, and δ3 of the working implement 2 as information items detected by the first angle detecting unit 18A, the second angle detecting unit 18B, and the third angle detecting unit 18C. A predetermined position of the working implement 2 obtained from the dimension and the rotation angles δ1, δ2, and δ3 of the working implement 2 may be, for example, the position of the front end of the blade 9 of the bucket 8 of the working implement 2, the position of the bucket pin 15, or the position of the first link pin 47*a*. The first angle detecting unit 18A, the second angle detecting unit 18B, and the third angle detecting unit 18C correspond to the second position detecting unit which detects the position of the excavator 100 as the work machine of the embodiment, for example, the position of the working implement 2. The second position detecting unit detects the position of the object according to a second method. In the embodiment, the second method is used to obtain the predetermined position of the excavator 100 from the dimension and the posture of the excavator 100 as the work machine of the embodiment, but the second method is not limited to the above-described method as long as the second method is different from the first method. In the embodiment, the predetermined position of the excavator 100 used in the second method is the same as the predetermined position of the excavator 100 as the measurement object of the first method. In the embodiment, the predetermined position of the excavator 100 used in the second method is the predetermined position of the working implement 2, but is not limited to the predetermined position of the working implement 2 as long as the predetermined position is a predetermined position of the component constituting the excavator 100.

Figure 7:
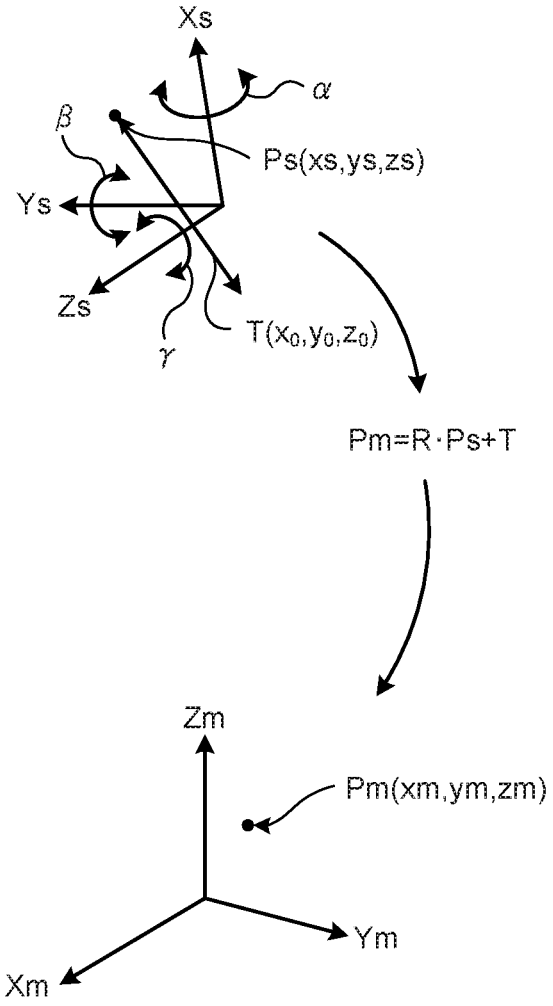
FIG. 7 is a diagram illustrating a calibration method according to the embodiment.

FIG. 7 is a diagram illustrating the calibration method according to the embodiment. When a stereoscopic imaging process is performed on the image of the object captured by at least the pair of image capturing devices 30, the position information item Ps (xs, ys, and zs) of the object can be obtained. As illustrated in FIG. 7, the obtained position information item Ps (xs, ys, and zs) is converted into the position information item Pm (xm, ym, and zm) of the coordinate system different from the image capturing device coordinate system (Xs, Ys, and Zs) from the image capturing device coordinate system (Xs, Ys, and Zs) as the coordinate system of the first position detecting unit. In the embodiment, the coordinate system different from the image capturing device coordinate system (Xs, Ys, and Zs) is the vehicle body coordinate system (Xm, Ym, and Zm), but the invention is not limited thereto.

The position information item Ps (xs, ys, and zs) obtained from at least the pair of image capturing devices 30 is three-dimensional information item indicated by the coordinate in the embodiment. By using the position information item Ps (xs, ys, and zs), a distance from the image capturing device 30 to the object is obtained. The calibration method according to the embodiment is used to obtain conversion information item used when the position information item Ps (xs, ys, and zs) obtained from at least the pair of image capturing devices 30 is converted into the position information item Pm (xm, ym, and zm) of the vehicle body coordinate system (Xm, Ym, and Zm) from the image capturing device coordinate system (Xs, Ys, and Zs). That is, the conversion information item is used to convert the position detected by at least the pair of image capturing devices 30 as the first position detecting unit from the coordinate system of the first position detecting unit into the coordinate system of the vehicle body 1.

The position information item Ps of the image capturing device coordinate system is converted into the position information item Pm of the vehicle body coordinate system by Equation (1). "R" in Equation (1) indicates the rotation matrix in Equation (2), and "T" in Equation (1) indicates the translation vector in Equation (3). "α" indicates the rotation angle about the axis Xs of the image capturing device coordinate system, "β" indicates the rotation angle about the axis Ys of the image capturing device coordinate system, and "γ" indicates the rotation angle about the axis Zs of the image capturing device coordinate system. The rotation matrix R and the translation vector T are conversion information item.

$$Pm = R \cdot Ps + T \tag{1}$$

$$R = \begin{pmatrix} 1 & 0 & 0 \\ 0 & \cos\alpha & -\sin\alpha \\ 0 & \sin\alpha & \cos\alpha \end{pmatrix} \begin{pmatrix} \cos\beta & 0 & \sin\beta \\ 0 & 1 & 0 \\ -\sin\beta & 0 & \cos\beta \end{pmatrix} \begin{pmatrix} \cos\gamma & -\sin\gamma & 0 \\ \sin\gamma & \cos\gamma & 0 \\ 0 & 0 & 1 \end{pmatrix} \tag{2}$$

$$T = \begin{pmatrix} x_0 \\ y_0 \\ z_0 \end{pmatrix} \tag{3}$$

The processing unit 21 obtains the above-described conversion information item when the calibration method according to the embodiment is performed. Specifically, the processing unit 21 obtains and outputs the conversion information item by using the first position information item detected by at least the pair of image capturing devices 30 and the second position information item detected by the first angle detecting unit 18A, the second angle detecting unit 18B, and the third angle detecting unit 18C. In the embodiment, at least the pair of image capturing devices 30 is the image capturing devices 30*c* and 30*d*, but may include the reference image capturing device 30*c*. The second position information item may be obtained by using a detection value of an IMU (Inertial Measurement Unit) 24 illustrated in FIGS. 1 and 2 and mounted in the excavator 100 in addition to detection values of angle detectors 18.

The first position information item is an information item of the predetermined position of the working implement 2 detected by at least the pair of image capturing devices 30 and the processing device 20 as the first position detecting unit, for example, the position of the blade 9 of the bucket 8. The second position information item is an information item of the predetermined position of the working implement 2 detected by the first angle detecting unit 18A, the second angle detecting unit 18B, and the third angle detecting unit 18C. The second position information item is an information item detected by the first angle detecting unit 18A as an example of the second position detecting unit in the posture of the working implement 2 when the first position detecting unit detects the predetermined position. Both the first position information item and the second position information item are information items obtained when the working implement 2 is located at the same position in the same posture of the working implement 2. That is, the first position information item and the second position information item are obtained according to different methods when the working implement 2 is located at the same position in the same posture of the working implement 2. In the embodiment, the first position information item and the second position information item are a plurality of information items obtained in the same posture of the working implement 2 during the operation of the working implement 2. The first and second position information items are obtained in a plurality of states.

The first position information item and the second position information item may be information items used to specify the predetermined position of the working implement 2. For example, the first position information item and the second position information item may be information items for the predetermined position of the working implement 2 and may be position information items of components attached to the working implement and having a known positional relation with respect to the working implement 2. That is, the first position information item and the second position information item are not limited to the information item of the predetermined position of the working implement 2.

The processing device 20 may be realized by dedicated hardware or a plurality of process circuits realizing the function of the processing device 20. Next, a process example will be described in which the processing device 20 performs the calibration method according to the embodiment.

Process Example

Figure 8:
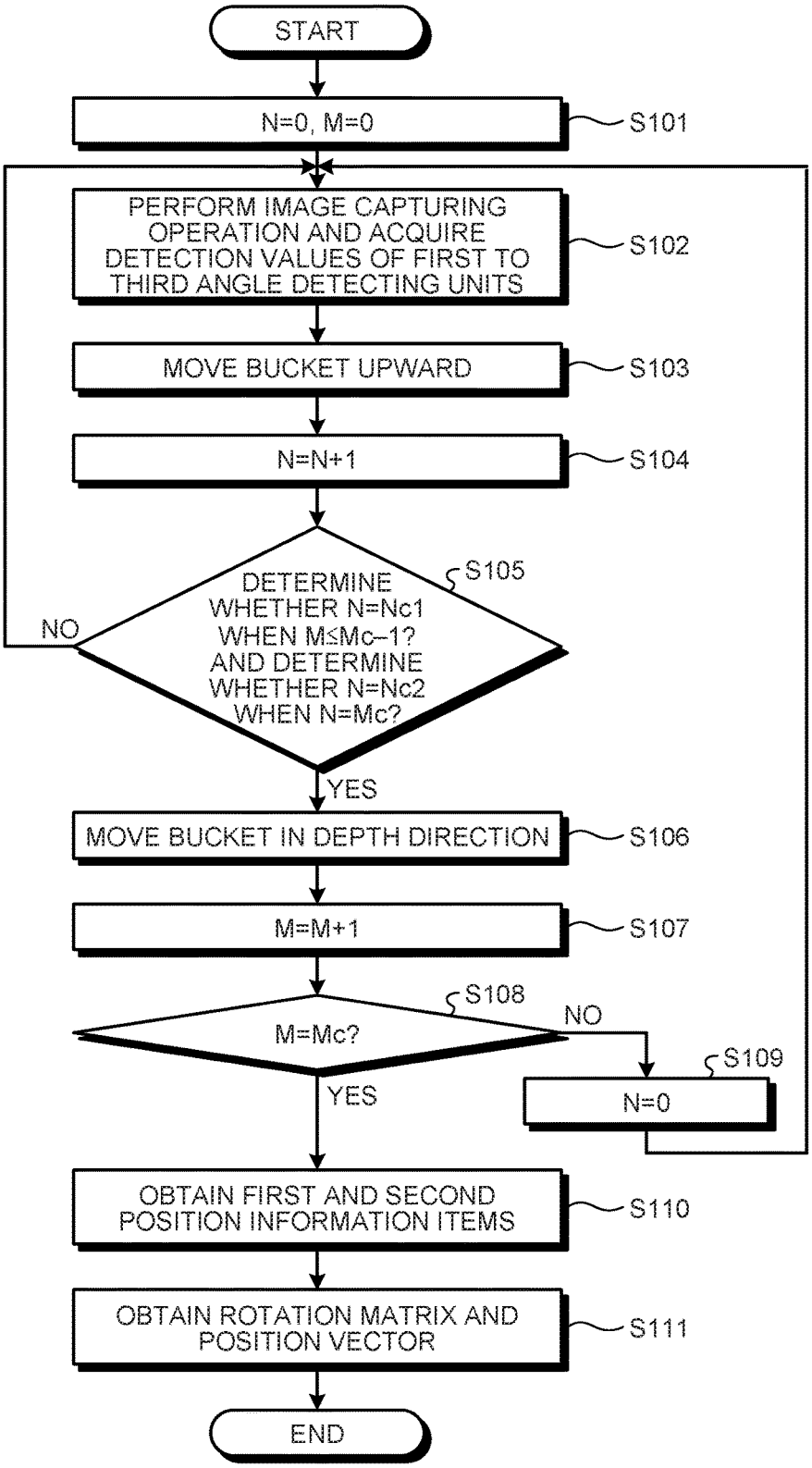
FIG. 8 is a flowchart illustrating a process example when a processing device according to the embodiment performs the calibration method according to the embodiment.
Figure 9:
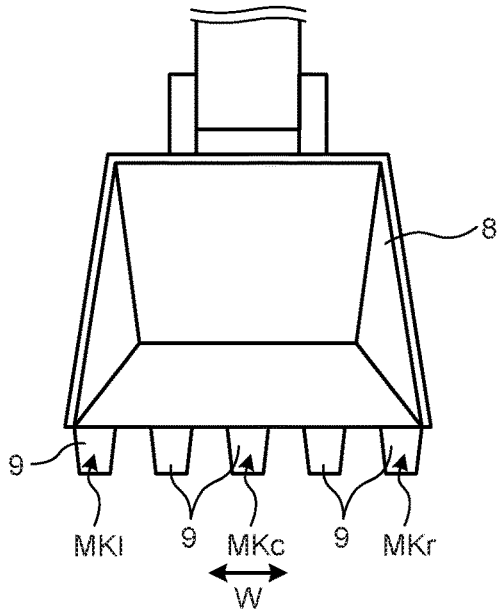
FIG. 9 is a diagram illustrating an object to be captured by an image capturing device 30 when the processing device according to the embodiment performs the calibration method according to the embodiment.
Figure 10:
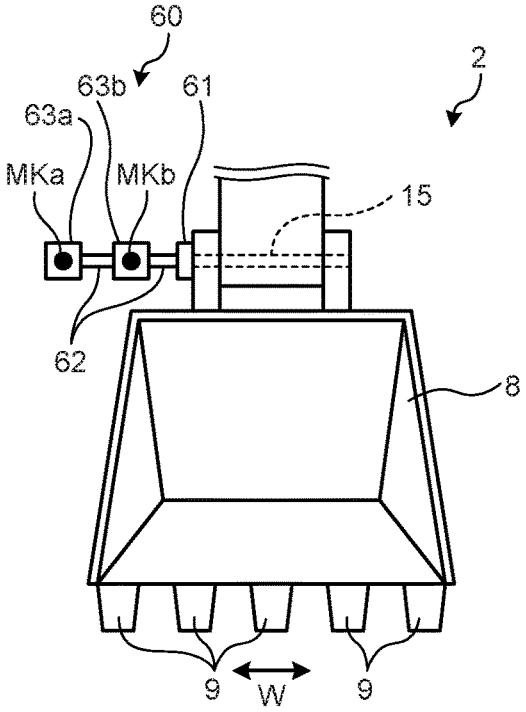
FIG. 10 is a diagram illustrating an object to be captured by the image capturing device when the processing device according to the embodiment performs the calibration method according to the embodiment.
Figure 11:
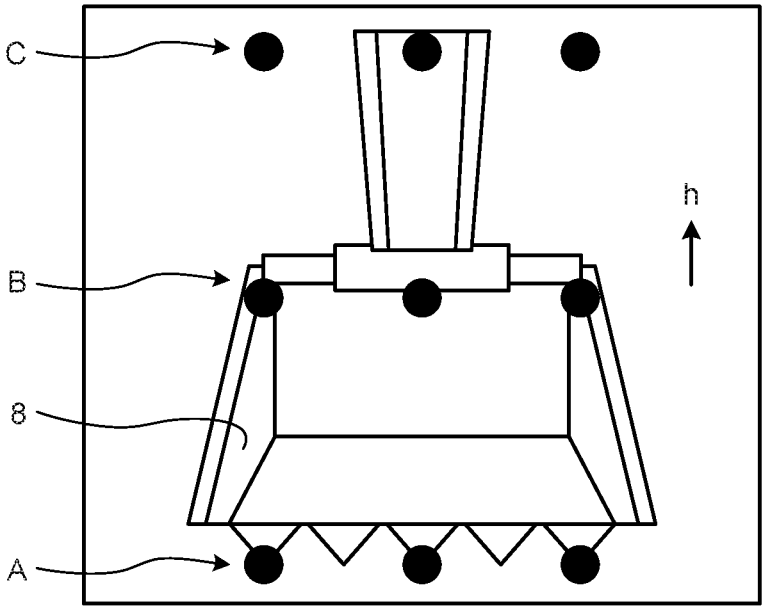
FIG. 11 is a diagram illustrating a posture of an object to be captured by the image capturing device when the processing device according to the embodiment performs the calibration method according to the embodiment.
Figure 13:
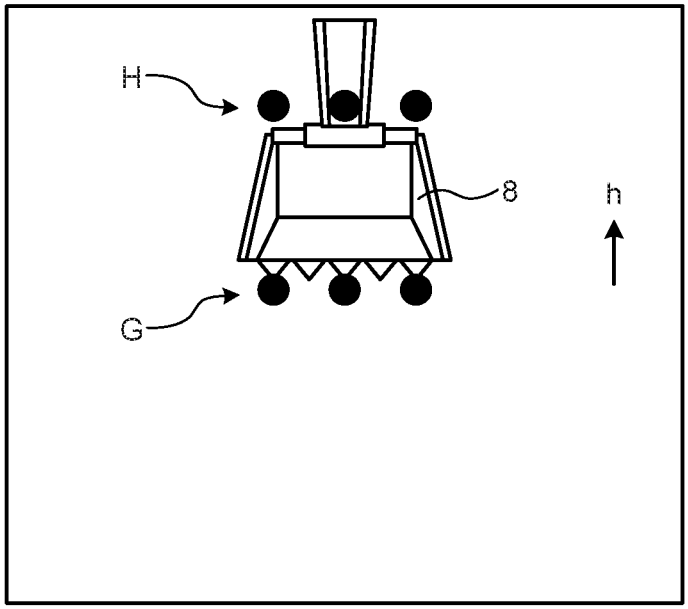
FIG. 13 is a diagram illustrating a posture of an object to be captured by the image capturing device when the processing device according to the embodiment performs the calibration method according to the embodiment.

FIG. 8 is a flowchart illustrating a process example in which the processing device 20 according to the embodiment performs the calibration method according to the embodiment. FIGS. 9 and 10 illustrate an object to be captured by the image capturing device 30 when the processing device 20 according to the embodiment performs the calibration method according to the embodiment. FIGS. 11 and 13 illustrate the posture of the object to be captured by the image capturing device 30 when the processing device 20 according to the embodiment performs the calibration method according to the embodiment.

The calibration method according to the embodiment is used to obtain the angles $\alpha$, $\beta$, and $\gamma$ of the rotation matrix R and the elements $x_0$, $y_0$, and $z_0$ of the translation vector, which are unknown values, from the first position information item as the information item of the predetermined position of the working implement 2 obtained by at least the pair of image capturing devices 30 and the second position information item detected by the first angle detecting unit 18A, the second angle detecting unit 18B, and the third angle detecting unit 18C. When the processing device 20 performs the calibration method according to the embodiment, the processing unit 21 sets counter numbers N and M to 0 in step S101.

In step S102, the processing unit 21 captures an object by the pair of image capturing devices 30*c* and 30*d*. Further, the processing unit 21 acquires the detection values of the first angle detecting unit 18A, the second angle detecting unit 18B, and the third angle detecting unit 18C.

The object captured by the pair of image capturing devices 30*c* and 30*d* is the predetermined position of the working implement 2. In the embodiment, the object corresponds to the bucket 8 of the excavator 100 and more specifically the blade 9. As illustrated in FIG. 9, the marks MKl, MKc, and MKr are provided in the blade 9 of the bucket 8. The mark MKl is provided at the leftmost blade 9, the mark MKc is provided at the center blade 9, and the mark MKr is provided at the rightmost blade 9. In the description below, the marks MKl, MKc, and MKr will be appropriately referred to as the mark MK unless otherwise specified.

In step S102, the processing unit 21 acquires the detection values of the first angle detecting unit 18A, the second angle detecting unit 18B, and the third angle detecting unit 18C in addition to the posture of the working implement 2 when the pair of image capturing devices 30*c* and 30*d* captures the bucket 8. In this way, in the embodiment, the processing unit 21 captures an object by the pair of image capturing devices 30*c* and 30*d* in the same posture of the working implement 2 and acquires the detection values of the first angle detecting unit 18A, the second angle detecting unit 18B, and the third angle detecting unit 18C. The processing unit 21 stores the image obtained by the image capturing operation of the image capturing device 30 and the detection values of the first angle detecting unit 18A, the second angle detecting unit 18B, and the third angle detecting unit 18C in the storage unit 22.

In the embodiment, the marks MKl, MKc, and MKr are arranged in series in a direction parallel to the width direction W of the bucket 8, that is, the extension direction of the bucket pin 15. In the embodiment, the width direction W of the bucket 8 indicates a direction in which the pair of image capturing devices 30*c* and 30*d* is arranged. The center blade 9 in the width direction W of the bucket 8 moves only in one plane, that is, the plane Xm-Zm in the vehicle body coordinate system. For this reason, since the constraint condition is weak when only the position of the center blade 9 is obtained, the precision in the direction of the axis Ym in the vehicle body coordinate system is degraded in the stereoscopic position measurement using the pair of image capturing devices 30*c* and 30*d*.

In the calibration method according to the embodiment, a plurality of positions in the width direction W of the bucket 8, that is, the positions of three blades 9 are measured so as to become the first position information items. For this reason, since a plurality of plane position information items in the width direction W of the bucket 8 can be used when the rotation matrix R and the translation vector T as the conversion information item are obtained, degradation in the precision of the rotation matrix R and the translation vector T is suppressed. Since the rotation matrix R and the translation vector T obtained by the calibration method according to the embodiment are used for the stereoscopic position measurement using the pair of image capturing devices 30*c* and 30*d*, degradation in the measurement precision in the direction of the axis Ym in the vehicle body coordinate system is suppressed.

In the embodiment, the marks MKl, MKc, and MKr are set in three blades 9 of the bucket 8, but the number of the marks MK, that is, the number of the blades 9 as the measurement objects is not limited to three. The mark MK may be provided in at least one blade 9. However, in order to suppress degradation in the stereoscopic position measurement precision using the pair of image capturing devices 30*c* and 30*d*, two or more marks MK are provided at the separated positions in the width direction W of the bucket 8 in the calibration method according to the embodiment. Here, it is desirable to measure two or more blades 9 in that high measurement precision is obtained.

FIG. 10 illustrates an example using a measurement target 60 attached to the working implement 2 instead of the position of the blade 9. In this example, at least the pair of image capturing devices 30 and the processing unit 21 measure the position of the measurement target 60 attached to the working implement 2, and the position of the measurement target is used as the first position information item in the calibration method according to the embodiment. The measurement target 60 includes target members 63*a* and 63*b* that are respectively provided with the marks MKa and MKb, a shaft member 62 that connects two target members 63*a* and 63*b* to each other, and a fixing member 61 that is attached to one end of the shaft member 62.

The target members 63*a* and 63*b* arranged in series in the extension direction of the shaft member 62. The fixing member 61 includes a magnet. When the fixing member 61 is absorbed to the working implement 2, for example, the target members 63*a* and 63*b* and the shaft member 62 are attached to the working implement 2. In this way, the fixing member 61 is attachable to the working implement 2 and is separable from the working implement 2. In the embodiment, when the fixing member 61 is absorbed to the bucket pin 15, the target members 63*a* and 63*b* and the shaft member 62 are fixed to the working implement 2. When the measurement target 60 is attached to the bucket pin 15, the target members 63*a* and 63*b* are arranged in series in the width direction W of the bucket 8.

The positions of the marks MKa and MKb of the measurement target 60 are obtained in advance from the dimension of the measurement target 60. The portion of the working implement 2 attached with the fixing member 61 in the measurement target 60 and the position of the blade 9 are obtained in advance from the dimension of the bucket 8. Thus, when the positions of the marks MKa and MKb of the measurement target 60 are given, the position of the blade 9 of the bucket 8 can be recognized. The positional relation of the marks MKa and MKb of the measurement target 60 with respect to the blade 9 of the bucket 8 is stored in the storage unit 22 of the processing device 20. When the calibration method according to the embodiment is performed, the processing unit 21 reads out the positional relation of the marks MKa and MKb of the storage unit 22 with respect to the blade 9 of the bucket 8 and uses the positional relation to generate the first position information item or the second position information item.

In step S102, when the image capturing operation using the pair of image capturing devices 30*c* and 30*d* and the predetermined position measurement using the detection values of the first angle detecting unit 18A, the second angle detecting unit 18B, and the third angle detecting unit 18C end, the process proceeds to step S103. In step S103, the processing unit 21 operates the working implement 2 so as to move the bucket 8 in a direction separated from the ground surface, that is, the upward direction. In step S104, the processing unit 21 sets a value obtained by adding 1 to the counter number N as a new counter number N.

In step S105, the processing unit 21 compares the current counter number N with a counter number threshold value Nc1 when the current counter number M is equal to or smaller than Mc−1. When the current counter number M is Mc, the processing unit 21 compares the current counter number N with a counter number threshold value Nc2. In the embodiment, the counter number threshold value Nc1 is 2. The counter number threshold value Nc2 is smaller than the counter number threshold value Nc1 and is, for example, 1.

In step S105, when the counter number N is not the counter number threshold value Nc1 (step S105, No), the processing unit 21 repeats the processes from step S102 to step S105. In step S105, when the counter number N is the counter number threshold value Nc1 (step S105, Yes), the process proceeds to step S106.

In step S106, the processing unit 21 operates the working implement 2 so as to move the bucket 8 in the depth direction, that is, a direction separated from the swing body 3 illustrated in FIG. 1. In step S107, the processing unit 21 sets a value obtained by adding 1 to the counter number M to a new counter number M. In step S108, the processing unit 21 compares the current counter number M with a counter number threshold value Mc. In the embodiment, the counter number threshold value Mc is 2.

In step S108, when the counter number M is not the counter number threshold value Mc (step S108, No), the processing unit 21 sets the counter number N to 0 in step S109. Subsequently, the processing unit 21 performs the processes from step S102 to step S105.

By step S101 to step S105, the pair of image capturing devices 30*c* and 30*d* captures the bucket 8 Nc+1 times in the up and down direction of the excavator 100 on the condition that the horizontal distance L between each of the plurality of image capturing devices 30 and the bucket 8 is the same. That is, the pair of image capturing devices 30*c* and 30*d* captures the bucket 8 Nc+1 times at the different position in the up and down direction of the bucket 8. The horizontal distance L is a distance between the swing body 3 and the bucket 8 in a direction parallel to the tread of the excavator 100, that is, the treads of the crawlers 5*a* and 5*b* illustrated in FIG. 1 and in a direction orthogonal to the extension direction of the boom pin 13 illustrated in FIG. 2. The plurality of image capturing devices 30 repeats the processes from step S106 to step S108 by differently setting the horizontal distance L as the distance between the bucket 8 and the swing body 3 parallel to the tread of the excavator 100 Mc+1 times. That is, the pair of image capturing devices 30*c* and 30*d* captures the bucket 8 Nc+1 times at the different horizontal distance L of the bucket 8.

Specifically, as illustrated in FIG. 11, the pair of image capturing devices 30*c* and 30*d* captures the bucket 8 at three positions, that is, a position A, a position B higher than the position A, and a position C higher than the position B on the condition of the horizontal distance L=L1. For this reason, in the horizontal distance L1, the position information items of the marks MKl, MKc, and MKr can be obtained at three different height levels. The positions A, B, and C become higher in a direction indicated by the arrow h of FIG. 11.

Figure 12:
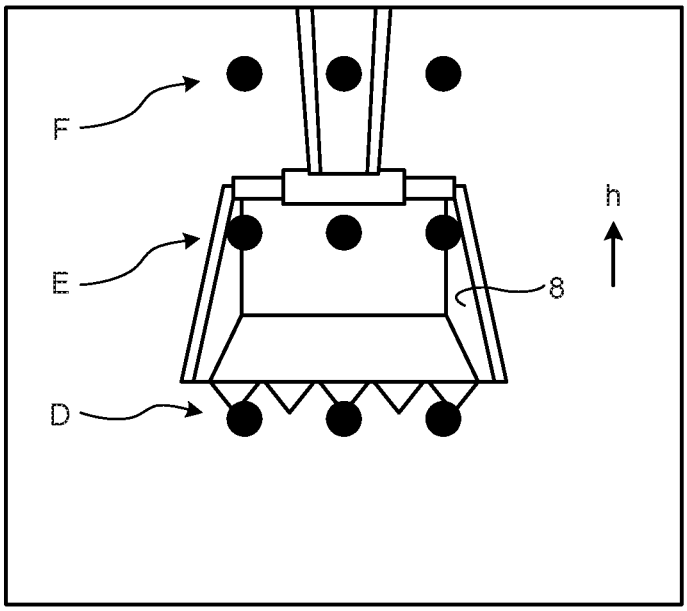
FIG. 12 is a diagram illustrating a posture of an object to be captured by the image capturing device when the processing device according to the embodiment performs the calibration method according to the embodiment.

As illustrated in FIG. 12, the pair of image capturing devices 30*c* and 30*d* captures the bucket 8 at three positions, that is, a position D, a position E higher than the position D, and a position F higher than the position E on the condition of the horizontal distance L=L2. For this reason, even in the horizontal distance L2, the position information items of the marks MKl, MKc, and MKr can be obtained at three different height levels. The horizontal distance L2 is longer than the horizontal distance L1. The state where the horizontal distance L2 is longer than the horizontal distance L1 indicates a state where the bucket 8 is located at a position separated from the image capturing device 30*c* and the image capturing device 30*d*. The positions D, E, and F become higher in a direction indicated by the arrow h of FIG. 12.

As illustrated in FIG. 13, the pair of image capturing devices 30*c* and 30*d* captures the bucket 8 at two positions, that is, a position G and a position H higher than the position G on the condition of the horizontal distance L=L3. For this reason, the position information items of the marks MKl, MKc, and MKr can be obtained at two different height levels in the horizontal distance L3. The horizontal distance L3 is longer than the horizontal distance L2. The state where the horizontal distance L3 is longer than the horizontal distance L2 indicates a state where the bucket 8 is located at a position further separated from the image capturing device 30*c* and the image capturing device 30*d*. The positions G and H become higher in a direction indicated by the arrow h of FIG. 13.

In the embodiment, in the case of L3 as the longest horizontal distance, the pair of image capturing devices 30*c* and 30*d* captures the bucket 8 at two positions in the up and down direction, but the image capturing position in the up and down direction is not limited to two positions. Further, when the bucket 8 is captured while the bucket is moved in the up and down direction at the same horizontal distance L, the image capturing position in the up and down direction is not limited to the embodiment.

The bucket 8 is captured by the pair of image capturing devices 30*c* and 30*d* eight times in total, that is, three times at the horizontal distance L1, three times at the horizontal distance L2, and two times at the horizontal distance L3. Since the constraint condition becomes stronger at the end of the image captured by the pair of image capturing devices 30*c* and 30*d* for the measurement objects, that is, the marks MKl, MKc, and MKr in the embodiment during the stereoscopic three-dimensional measurement, the measurement precision is improved. For this reason, the processing unit 21 captures the bucket 8 and more specifically the marks MKl, MKc, and MKr by the pair of image capturing devices 30*c* and 30*d* at a plurality of height positions at the same horizontal distance L. In this way, since the marks MKl, MKc, and MKr are disposed at both ends of the image captured by the plurality of image capturing devices 30, that is, both ends in the up and down direction, the measurement precision is improved.

In the embodiment, the horizontal distance L is changed into three levels and the image capturing operation is performed three times or two times in the height direction. However, the invention is not limited thereto. The number of times of changing the horizontal distance L is changed by changing the counter number threshold value Mc. The number of times of capturing an object in the height direction is changed by changing at least one of the counter number threshold value Nc1 and the counter number threshold value Nc2.

The stereoscopic three-dimensional precision is improved in the wider range when the object located at a far position is measured in the stereoscopic three-dimensional measurement. For this reason, the processing unit 21 captures the bucket 8 and more specifically the marks MKl, MKc, and MKr by the pair of image capturing devices 30 while changing the horizontal distance L of the bucket 8. In this way, the three-dimensional measurement precision is improved in a wide range.

Returning to step S108, when the counter number M is the counter number threshold value Mc (step S108, Yes), the process proceeds to step S110. In step S110, the processing unit 21 obtains the first position information item and the second position information item. Specifically, the processing unit 21 acquires plural pairs of images (in the embodiment, eight images) obtained by capturing the bucket 8 using the pair of image capturing devices 30*c* and 30*d* plural times (in the embodiment, eight times) from the storage unit 22. Then, the processing unit 21 three-dimensionally measures the positions of the marks MKl, MKc, and MKr by performing a stereoscopic imaging process on a pair of images among plural pairs of images. In the embodiment, the processing unit 21 extracts the marks MKl, MKc, and MKr by the imaging process. For example, the processing unit 21 can extract the image of the mark based on the characteristics of the shapes of the marks MKl, MKc, and MKr. As will be described below, the marks MKl, MKc, and MKr may be selected while the operator operates the input device 52 illustrated in FIG. 6.

In the three-dimensional measurement, the processing unit 21 obtains the positions of the marks MKl, MKc, and MKr existing in the pair of images obtained from the pair of image capturing devices 30*c* and 30*d* in terms of triangulation. The position information items of the marks MKl, MKc, and MKr correspond to the first position information item. The processing unit 21 obtains the first position information item from each image capturing result at eight positions in step S101 to step S109 and outputs the first position information item to, for example, the storage unit 21 so as to temporarily store the first position information item therein.

Since three marks MKl, MKc, and MKr provided at different positions are captured by the image capturing operation at one position, three first position information items can be obtained by one image capturing operation. As described above, since the bucket 8 is captured at eight positions, twenty four first position information items can be obtained in total.

In step S110, the processing unit 21 acquires the dimension of the working implement 2 and the detection values of the first angle detecting unit 18A, the second angle detecting unit 18B, and the third angle detecting unit 18C. The detection values of the first angle detecting unit 18A and the like are values detected by the first angle detecting unit 18A and the like when the working implement 2 takes a posture in which the bucket 8 is captured by the pair of image capturing devices 30*c* and 30*d*. The processing unit 21 obtains the position of the blade 9 of the bucket 8 and more specifically the positions of the marks MKl, MKc, and MKr from the detection value and the dimension of the working implement 2. The position items of the marks MKl, MKc, and MKr obtained from the detection values of the first angle detecting unit 18A and the like and the dimension of the working implement 2 correspond to the second position information item. The processing unit 21 obtains the second position information item from each image capturing result at eight positions in step S101 to step S109 and outputs the second position information item to, for example, the storage unit 21 so as to temporarily store the second position information item therein.

By the image capturing operation at one position, three second position information items can be obtained. As described above, since the bucket 8 is captured at eight positions, twenty four second position information items can be obtained in total. The processing unit 21 correlates the first position information item and the second position information item obtained in the posture of the same working implement 2 and temporarily stores the correlation result in the storage unit 22. In the embodiment, the combination of the first position information item and the second position information item is twenty four in total.

In step S111, the processing unit 21 obtains the rotation matrix R and the translation vector T by using the first position information item and the second position information item. More specifically, the processing unit 21 obtains the angles $\alpha$, $\beta$, and $\gamma$ of the rotation matrix R and the elements $x_0$, $y_0$, and $z_0$ of the translation vector T by using the first position information item and the second position information item. When the angles $\alpha$, $\beta$, and $\gamma$ and the elements $x_0$, $y_0$, and $z_0$ are obtained, twenty four combinations of the first position information item and the second position information item are used, but a combination having a large error may be excluded. In this way, degradation in the precision of the angles α, β, and γ and the elements $x_0$, $y_0$, and $z_0$ is suppressed.

Since the first position information item is the coordinate of the vehicle body coordinate system, the first position information item is expressed as (xm, ym, and zm). Since the second position information item is the image capturing device coordinate system, the second position information item is expressed by (xs, ys, and zs). J of Equation (4) is obtained by subtracting the right side from the left side of Equation (1) and squaring the result.

$$J=\{Pmi-(R\cdot Psi+T)\}^2 \tag{4}$$

The processing unit 21 reads out the first position information item and the second position information item obtained in the posture of the same working implement 2 from the storage unit 22, gives the first position information item to the position information item Pm of Equation (4), and gives the second position information item to the position information item Ps of Equation (4). Then, three equations including any one of the angles α, β, and γ of the rotation matrix R and the elements $x_0$, $y_0$, and $z_0$ of the translation vector T can be obtained. In the embodiment, since the combinations of the first position information item and the second position information item are twenty four, the processing unit 21 obtains seventy two values of J including any one of the angles α, β, and γ of the rotation matrix R and the elements $x_0$, $y_0$, and $z_0$ of the translation vector T by giving twenty four combinations of the first position information item and the second position information item to Equation (4).

The total sum JS of seventy two values of J is obtained from Equation (5). The processing unit 21 obtains the total sum JS from Equation (5).

$$JS=\Sigma Ji=\Sigma\{Pmi-(R\cdot Psi+T)\}^2,\{i:1 \text{ to } 72\} \tag{5}$$

Next, the processing unit 21 sets JS at the minimum value. For this reason, the processing unit 21 sets the result obtained by the partial differential of the angle α, the angle β, the angle γ, the element $x_0$, the element $y_0$, and the element $z_0$ in $\Sigma\{Pmi-(R\cdot Psi+T)\}^2$ so that the result becomes 0. The processing unit 21 obtains the angles α, β, and γ and the element $x_0$, $y_0$, and $z_0$ of the translation vector T by solving six equations obtained in this way through, for example, Newton-Raphson method. The processing unit 21 obtains the rotation matrix R and the translation vector T from the angles α, β, and γ and the element $x_0$, $y_0$, and $z_0$ of the translation vector T. The rotation matrix R and the translation vector T obtained in this way are the conversion information items used to convert the position information item of the object detected by the first position detecting unit into the coordinate system other than the first position detecting unit, that is, the vehicle body coordinate system in the embodiment.

In addition, the processing unit 21 may obtain the conversion information item used to convert the position of the object detected by the second position detecting unit into the coordinate system different from the coordinate system of the second position detecting unit, for example, the coordinate system of the first position detecting unit. In this case, the position of the object in the coordinate system of the second position detecting unit detected by the second position detecting unit can be converted into the coordinate system of the first position detecting unit by Equation (6). In this example, the coordinate system of the second position detecting unit is the vehicle body coordinate system, and the coordinate system of the first position detecting unit is the image capturing device coordinate system.

$$Ps=R^{-1}\cdot Pm-R^{-1}\cdot T \tag{6}$$

$R^{-1}$ of Equation (6) indicates the inverse matrix of the rotation matrix of Equation (2), and T of Equation (6) indicates the translation vector of Equation (3). The position information item Pm indicates the position of the object in the vehicle body coordinate system, and the position information item Ps indicates the position of the object in the image capturing device coordinate system. The inverse matrix $R^{-1}$ and the product of the translation vector T and $R^{-1}$ indicate the conversion information items. In this way, the process of the processing unit 21 and the calibration method of the embodiment can obtain the conversion information item used to convert the position detected by the second position detecting unit from the coordinate system of the second position detecting unit into the coordinate system different from the coordinate system of the second position detecting unit and output the conversion information item.

In the embodiment, the second position detecting unit includes the first angle detecting unit 18A, the second angle detecting unit 18B, and the third angle detecting unit 18C, but the invention is not limited thereto. For example, it is assumed that the excavator 100 includes a position detecting system that includes an antenna for RTK-GNSS (Real Time Kinematic-Global Navigation Satellite Systems) and measures the position of the antenna by GNSS so as to detect the position of the own vehicle. In this case, the position detecting system is set as the second position detecting unit, and the position of the GNSS antenna is set as a predetermined position of the work machine. Then, the position of the GNSS antenna is detected by the first position detecting unit and the second position detecting unit while the position of the GNSS antenna is changed so as to obtain the first position information item and the second position information item. The processing unit 21 obtains the conversion information item used to convert the position information item of the object detected by the first position detecting unit into the coordinate system other than the first position detecting unit, that is, the vehicle body coordinate system in the embodiment by using the first position information item and the second position information item. Further, the processing unit 21 can obtain the conversion information item for converting the position information item of the object detected by the second position detecting unit into the coordinate system other than the second position detecting unit by using the first position information item and the second position information item.

In addition, when a removable GNSS receiver is attached to a predetermined position of the excavator 1, for example, a predetermined position of the traveling body 5 or the working implement 2 so that the GNSS receiver is used as the second position detecting unit, the conversion information item can be obtained as in the case where the position detecting system for detecting the position of the own vehicle is set as the second position detecting unit.

The calibration system 50 and the calibration method according to the embodiment obtain a predetermined position of the working implement 2 by using the first position detecting unit and the second position detecting unit different from the first position detecting unit detecting the position of the object in the same posture of the working implement 2 of the excavator 100. Then, the calibration system 50 and the calibration method according to the embodiment obtain the rotation matrix R and the translation vector T by using the first position information item obtained by the first position detecting unit and the second position information item obtained by the second position detecting unit. By such a process, the calibration system 50 and the calibration method according to the embodiment can obtain the conversion information item for converting the position information item of the object detected by the first position detecting unit into the coordinate system other than the first position detecting unit.

When a stereoscopic imaging process is performed on the image of the object captured by at least the pair of image capturing devices 30 of the plurality of image capturing devices 30, the position information item of the object in the image capturing device coordinate system can obtained. When the conversion information item can be obtained by the calibration system 50 and the calibration method according to the embodiment, the position information item of the object in the image capturing device coordinate system can be converted into the position information item in the vehicle body coordinate system. For this reason, the excavator 100 can control the working implement 2 by using the converted position information item of the object or display a guidance screen of the working implement 2 on a monitor.

Since the calibration system 50 and the calibration method according to the embodiment use the processing device 20 and the pair of image capturing devices 30*c* and 30*d* provided in the excavator 100, an external device for obtaining the rotation matrix R and the translation vector T is not needed. For this reason, the calibration system 50 and the calibration method according to the embodiment can obtain the rotation matrix R and the translation vector T, for example, in a place where the excavator 100 is operated by a user. In this way, the calibration system 50 and the calibration method according to the embodiment have an advantage that the rotation matrix R and the translation vector T can be obtained even when an external device for obtaining the rotation matrix R and the translation vector T is not provided.

The calibration system 50 and the calibration method according to the embodiment can increase the information quantity for obtaining the rotation matrix R and the translation vector T as the conversion information item by setting the first position information item and the second position information item as the predetermined position information items detected in a different posture of the working implement 2. As a result, the calibration system 50 and the calibration method according to the embodiment can obtain the rotation matrix R and the translation vector T with high precision.

In the embodiment, the first position detecting unit is set as the stereo camera including at least the pair of image capturing devices 30, but the invention is not limited thereto. The first position detecting unit may be, for example, a laser scanner or a 3D scanner. The work machine is not limited to the excavator 100 as long as at least the pair of image capturing devices is provided and the object is stereoscopically and three-dimensionally measured by the pair of image capturing devices. For example, the work machine may be a wheel loader or a bulldozer as long as the working implement is provided.

In the embodiment, the marks MKl, MKc, and MKr are provided in the blade 9 in order to obtain the rotation matrix R and the translation vector T, but these marks are not essentially needed. For example, the input device 52 illustrated in FIG. 6 may be used to designate a portion for obtaining the position by the processing unit 21, for example, a portion of the blade 9 of the bucket 8 within the image of the object captured by the image capturing device 30. In this case, the processing unit 21 three-dimensionally measures a designated portion.

While the embodiment has been described above, the embodiment is not limited to the above-described content. Further, the above-described components include a component which is easily supposed by the person skilled in the art, a component which has substantially the same configuration, and a component which is included in the so-called equivalent range. The above-described components can be appropriately combined with one another. At least one of various omissions, replacements, and modifications of the components can be made without departing from the spirit of the embodiment.

REFERENCE SIGNS LIST

1 VEHICLE BODY
2 WORK MACHINE
3 SWING BODY
4 CAB
5 TRAVELING BODY
6 BOOM
7 ARM
8 BUCKET
9 BLADE
10 BOOM CYLINDER
11 ARM CYLINDER
12 BUCKET CYLINDER
13 BOOM PIN
14 ARM PIN
15 BUCKET PIN
18A FIRST ANGLE DETECTING UNIT
18B SECOND ANGLE DETECTING UNIT
18C THIRD ANGLE DETECTING UNIT
20 PROCESSING DEVICE
21 PROCESSING UNIT
22 STORAGE UNIT
23 INPUT/OUTPUT UNIT
25 OPERATION DEVICE
26 MONITOR PANEL
30*a*, 30*b*, 30*c*, 30*d* IMAGE CAPTURING DEVICE
50 CALIBRATION SYSTEM
52 INPUT DEVICE
60 MEASUREMENT TARGET
100 EXCAVATOR
P3 BLADE TIP
R ROTATION MATRIX
T TRANSLATION VECTOR
W WIDTH DIRECTION
$x_0$, $y_0$, $z_0$ ELEMENT
$\alpha$, $\beta$, $\gamma$ ANGLE

The invention claimed is:

1. A calibration system comprising:

a first position detecting unit which is provided in a work machine including a working implement so as to detect a position of an object; and a processing unit which obtains and outputs (i) a conversion information item used to convert the position detected by the first position detecting unit from a coordinate system of the first position detecting unit into a coordinate system different from the coordinate system of the first position detecting unit or (ii) a conversion information item used to convert the position detected by a second position detecting unit, which is different from the first position detecting unit, from a coordinate system of the second position detecting unit into a coordinate system different from the coordinate system of the second position detecting unit, by using a first position information item as an information item for a predetermined position of the work machine detected by the first position detecting unit and a second position information item as an information item for the predetermined position detected by the second position detecting unit in a same posture of the work machine when the first position detecting unit detects the predetermined position.

2. The calibration system according to claim 1, wherein the first position information item corresponds to a plurality of information items obtained when the first position detecting unit detects the predetermined position in a different posture of the work machine, and wherein the second position information item corresponds to a plurality of information items obtained when the second position detecting unit detects the predetermined position in a different posture of the work machine.

3. The calibration system according to claim 1, wherein the first position detecting unit is a stereo camera including at least a pair of image capturing devices, and wherein the second position detecting unit is a sensor provided in the work machine so as to detect an operation amount of an actuator operating the working implement.

4. The calibration system according to claim 3, wherein the predetermined position corresponds to a plurality of positions of the work machine in an arrangement direction of the pair of image capturing devices constituting the stereo camera.

5. A work machine comprising:

a working implement; and the calibration system according to claim 1.

6. A calibration method comprising:

detecting a predetermined position of a work machine according to a first method and a second method in a different posture of the work machine, the second method being different from the first method; and obtaining a conversion information item used to (i) convert a position detected by the first method from a coordinate system in the first method into a coordinate system different from the coordinate system of the first method or (ii) convert a position detected by the second method from a coordinate system of the second method into a coordinate system different from the coordinate system of the second method, by using a first position information item as an information item for the predetermined position detected by the first method and a second position information item as an information item for the predetermined position detected by the second method in a same posture of the work machine when the predetermined position is detected by the first method.

7. The calibration method according to claim 6, wherein the first position information item and the second position information item are a plurality of information items obtained in various states and respectively obtained when the work machine takes a different posture during an operation of the work machine.

8. The calibration method according to claim 6, wherein the first method is to stereoscopically and three-dimensionally measure the predetermined position, and wherein the predetermined position corresponds to a plurality of positions of the work machine in an arrangement direction of a pair of image capturing devices used for the stereoscopic and three-dimensional measurement.

9. A calibration system comprising:

an image capturing device which is provided in a work machine including a working implement so as to detect a position of an object;

an angle detecting unit configured to detect a rotation angle of the work implement;

and a processing unit configured to:

detect a first position information item as an information item for a predetermined position of the work machine in an image capturing device coordinate system based on an image captured by the image capturing device;

detect a second position information item as an information item for the predetermined position in a vehicle body coordinate system based on a detected value detected by the angle detecting unit in a same posture of the work machine when the image capturing device detects the predetermined position; and output a conversion information item used for a conversion between the image capturing device coordinate system and the vehicle body coordinate system.

* * * * *